US010916895B2

(12) United States Patent
Chen

(10) Patent No.: US 10,916,895 B2
(45) Date of Patent: Feb. 9, 2021

(54) DOUBLE-SHIELDED HIGH-SPEED DOCKING CONNECTOR

(71) Applicant: OUPIIN ELECTRONIC (KUNSHAN) CO., LTD., Kunshan (CN)

(72) Inventor: Xinzhi Chen, Kunshan (CN)

(73) Assignee: OUPIIN ELECTRONIC (KUNSHAN) CO., LTD., Kunshan (CN)

( * ) Notice: Subject to any disclaimer, the term of this patent is extended or adjusted under 35 U.S.C. 154(b) by 0 days.

(21) Appl. No.: 16/628,024

(22) PCT Filed: Feb. 7, 2018

(86) PCT No.: PCT/CN2018/075553

§ 371 (c)(1),
(2) Date: Jan. 1, 2020

(87) PCT Pub. No.: WO2019/144440

PCT Pub. Date: Aug. 1, 2019

(65) Prior Publication Data

US 2020/0313362 A1 Oct. 1, 2020

(30) Foreign Application Priority Data

Jan. 29, 2018 (CN) ..... 2018 1 0084745

(51) Int. Cl.

| | |
|---|---|
| ***H01R 12/71*** | (2011.01) |
| ***H01R 13/502*** | (2006.01) |
| ***H01R 13/514*** | (2006.01) |
| ***H01R 13/518*** | (2006.01) |
| ***H01R 13/6587*** | (2011.01) |

(52) U.S. Cl.
CPC ..... *H01R 13/6587* (2013.01); *H01R 12/716* (2013.01); *H01R 13/502* (2013.01); *H01R 13/514* (2013.01); *H01R 13/518* (2013.01)

(58) Field of Classification Search
CPC ..... H01R 13/6587; H01R 12/716; H01R 13/502; H01R 13/514; H01R 13/512
USPC ..... 439/607.32
See application file for complete search history.

(56) References Cited

U.S. PATENT DOCUMENTS

| | | | | |
|---|---|---|---|---|
| 6,863,543 B2 * | 3/2005 | Lang | ..... | H01R 13/6594 439/75 |
| 7,549,897 B2 * | 6/2009 | Fedder | ..... | H01R 12/585 439/607.01 |
| 7,811,128 B2 * | 10/2010 | Pan | ..... | H01R 23/688 439/607.05 |

(Continued)

*Primary Examiner* — Alexander Gilman
(74) *Attorney, Agent, or Firm* — Mark M. Friedman

(57) ABSTRACT

A double-shielded high-speed docking connector is disclosed in this invention. The connector includes a shell, a positioning seat and a row of frame assemblies. The frame assembly includes an insulating body, two columns of signal terminals supported by the insulating body and arranged to be multiple differential pairs, a first shielding member mounted on one side of the insulating body, and a second shielding member mounted on the other side of the insulating body and connected with the first shielding member. The double-shielded high-speed docking connector of the present invention can not only reduce crosstalk between the signal terminals of adjacent differential pairs, but also effectively reduce signal interference of adjacent frame assemblies by disposing two shielding members on each frame assembly.

9 Claims, 20 Drawing Sheets

(56) References Cited

U.S. PATENT DOCUMENTS

| | | | | |
|---|---|---|---|---|
| 7,862,376 | B2 * | 1/2011 | Sypolt | H01R 13/6587 439/607.07 |
| 8,465,302 | B2 * | 6/2013 | Regnier | H01R 13/46 439/108 |
| 8,753,148 | B2 * | 6/2014 | Wozniak | H01R 12/585 439/607.05 |
| 8,771,017 | B2 * | 7/2014 | Vino, IV | H01R 13/6587 439/607.56 |
| 9,093,800 | B2 * | 7/2015 | Laub | H01R 13/035 |
| 9,130,314 | B2 * | 9/2015 | Pao | H01R 13/6587 |
| 9,225,122 | B1 * | 12/2015 | Evans | H01R 13/6587 |
| 9,257,801 | B2 * | 2/2016 | Fang | H01R 13/6587 |
| 9,312,618 | B2 * | 4/2016 | Regnier | H01R 12/71 |
| 9,627,818 | B1 * | 4/2017 | Chen | H01R 12/707 |
| 9,722,342 | B2 * | 8/2017 | Yuan | H01R 13/428 |
| 10,027,063 | B2 * | 7/2018 | Peng | H01R 13/516 |
| 10,170,864 | B1 * | 1/2019 | Hsu | H01R 13/521 |
| 10,186,811 | B1 * | 1/2019 | Trout | H01R 13/428 |
| 10,205,286 | B2 * | 2/2019 | Provencher | H01R 43/24 |
| 10,224,674 | B1 * | 3/2019 | Huang | H01R 13/6471 |
| 10,305,211 | B2 * | 5/2019 | Lu | H01R 4/029 |
| 10,468,824 | B2 * | 11/2019 | Lin | H01R 13/6585 |
| 10,476,210 | B1 * | 11/2019 | Trout | H01R 13/6587 |
| 2016/0141807 | A1 * | 5/2016 | Gailus | H01R 13/6461 439/607.05 |
| 2017/0025783 | A1 * | 1/2017 | Astbury | H01R 13/6474 |

* cited by examiner

DOUBLE-SHIELDED HIGH-SPEED DOCKING CONNECTOR

CROSS-REFERENCE TO RELATED APPLICATIONS

This application is based upon and claims the benefit of priority from Chinese Patent Application No. 201810084745.9, filed on Jan. 29, 2018; and International Application PCT/CN2018/075553, filed on Feb. 7, 2018 the entire contents of which are incorporated herein by reference.

BACKGROUND OF THE INVENTION

1. Field of the Invention

The present invention relates to a connector, and more particularly to a double-shielded high-speed docking connector being capable of reducing crosstalk between signal terminals of adjacent differential pairs.

2. Description of the Prior Art

High-speed docking connectors are used in market such as networks and wireless devices to provide high-speed or higher-speed transmission. As the intermediary of signal interconnection and transmission, the high-speed docking connector plays an extremely important role.

In the high-speed docking connector, differential signal has been widely used because of its good anti-jamming performance. But in application, the existing structure of the high-speed docking connector can not eliminate the crosstalk noise between signal terminals of adjacent differential pairs, so it will seriously affect the signal integrity of high-speed system.

Hence, the applicant is active to study a high-speed docking connector that can effectively reduce the crosstalk between adjacent differential pairs.

BRIEF SUMMARY OF THE INVENTION

A primary object of the present invention is to provide a double-shielded high-speed docking connector, being capable of effectively reducing crosstalk between signal terminals of adjacent differential pairs and reducing signal interference between adjacent frame assemblies.

Other objects and advantages of the present invention may be further understood from the technical features disclosed by the present invention.

To achieve the aforementioned object, the present invention adopts the following technical solution.

A double-shielded high-speed docking connector comprises a longitudinal die-casting metal shell, a longitudinal positioning seat and a row of frame assemblies. The shell has a top wall, a bottom wall, two side walls, and a cavity defined by the top wall, the bottom wall and the two side walls. The shell further has a row of parallel stepped vertical walls located on a rear of the shell and perpendicular to the top wall, and a plurality of horizontal passages separated by the vertical walls and communicated with the cavity. The positioning seat has a row of parallel stepped upright walls, and a plurality of vertical passages separated by the upright walls and passing through a bottom of the positioning seat. Each frame assembly includes an insulating body, two columns of signal terminals supported by the insulating body and arranged to be multiple differential pairs, a first shielding member mounted on one side of the insulating body, and a second shielding member mounted on the other side of the insulating body and connected with the first shielding member. Wherein each signal terminal has a conductive contact portion exposed on a front of the insulating body, and a conductive tail extending out of a bottom of the insulating body. The conductive contact portion passes through the corresponding horizontal passage to enter into the cavity of the shell; and the conductive tail passes through the corresponding vertical passage to extend out of the bottom of the positioning seat.

In one embodiment, the insulating body has at least one retaining groove passing through two sides of the insulating body and located between the signal terminals of two adjacent differential pairs.

In one embodiment, the first shielding member has a first vertical main portion attached on one side of the insulating body, and at least one retaining arm entering into the retaining groove of the insulating body; and the second shielding member has a second vertical main portion attached on the other side of the insulating body, and at least one elastic panel formed on the second vertical main portion, and at least one locking hole formed on the elastic panel and aligned with the retaining groove; wherein a front end of the retaining arm of the first shielding member inserts into the locking hole of the second shielding member to make the first and second shielding member be connected and fixed on the insulating body together.

In one embodiment, the insulating body is combined by two half parts, one of which supports one column of signal terminals, and the other of which supports the other column of signal terminals; the two half parts are combined together to make the two columns of signal terminals construct multiple differential pairs; the retaining groove passes through the two half parts, and there is at least one retaining groove between each two adjacent signal terminals on each half part.

In one embodiment, the retaining arm of the first shielding member is vertically bent toward the insulating body, and forms at least one dentate insertion plate on the front end of the retaining arm; and the elastic panel of the second shielding member protrudes toward the insulating body.

In one embodiment, the insulating body further disposes at least one heat dissipation channel on each side thereof; the first shielding member further has at least one first opening formed on the first vertical main portion; and the second shielding member further has at least one second opening formed on the second vertical main portion; wherein the first and second openings are corresponding to and communicated with the heat dissipation channel of the insulating body.

In one embodiment, the first shielding member further has at least one first bending sheet, which is formed by being bent far away from the insulating body for contacting with the second shielding member of one adjacent frame assembly; and the second shielding member further has at least one second bending sheet, which is formed by being bent far away from the insulating body for contacting with the first shielding member of the other adjacent frame assembly.

In one embodiment, the double-shielded high-speed docking connector further includes a row of mountain-like grounding pieces; and the positioning seat forms a plurality of transverse grounding grooves located on the bottom of the positioning seat, and each transverse grounding groove is corresponding to a bottom of one corresponding upright wall; wherein each grounding piece is mounted in the corresponding transverse grounding groove.

In one embodiment, each grounding piece is in the shape of mountains; and the grounding piece has a transverse beam, three U-shaped holding portions formed on the transverse beam, and three grounding tails formed on the U-shaped holding portions respectively.

In one embodiment, each U-shaped holding portion has a base portion and two arm portions being symmetrically located on two sides of the base portion and being perpendicular to the base portion.

In one embodiment, the double-shielded high-speed docking connector further includes a long strip-like fixer, which has a horizontal holding plate and a vertical holding plate being perpendicular to each other; the horizontal holding plate is fixed on the top wall of the shell, and the vertical holding plate is fixed on a rear of the positioning seat.

In comparison with the prior art, the double-shielded high-speed docking connector of the present invention disposes two shielding members connected or combined together on each frame assembly, thereby not only reducing the crosstalk between the signal terminals of adjacent differential pairs, but also effectively reducing signal interference of adjacent frame assemblies. Moreover, the present invention disposes the grounding pieces to further reduce the crosstalk.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "up", "down", "front", "rear", "left", "right", "top", "bottom" etc., are only used with reference to the orientation of the accompanying drawings. Therefore, the used directional terms are intended to illustrate, but not to limit, the present invention.

Figure 1:
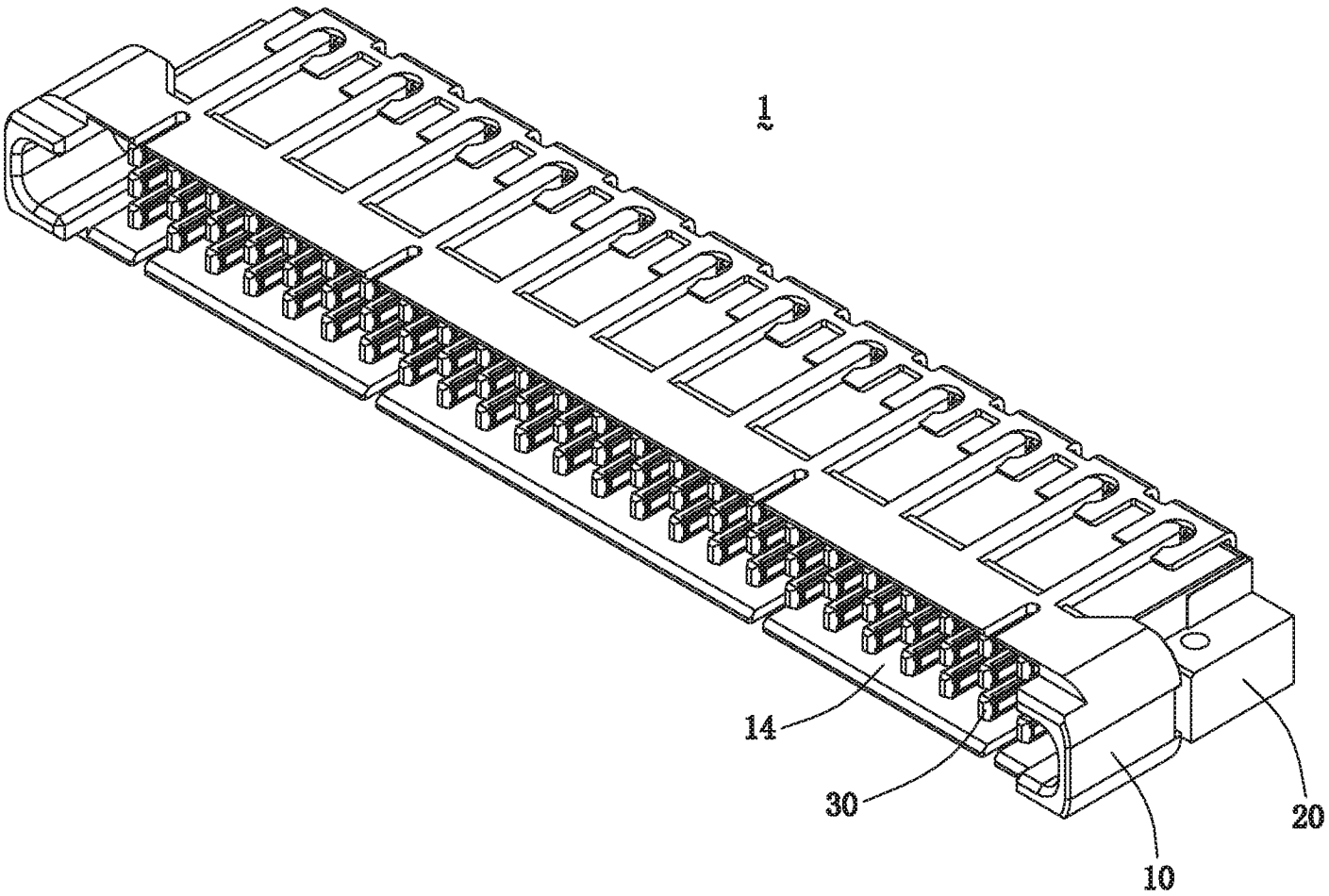
FIG. 1 is a perspective schematic view of a double-shielded high-speed docking connector of the present invention.
Figure 2:
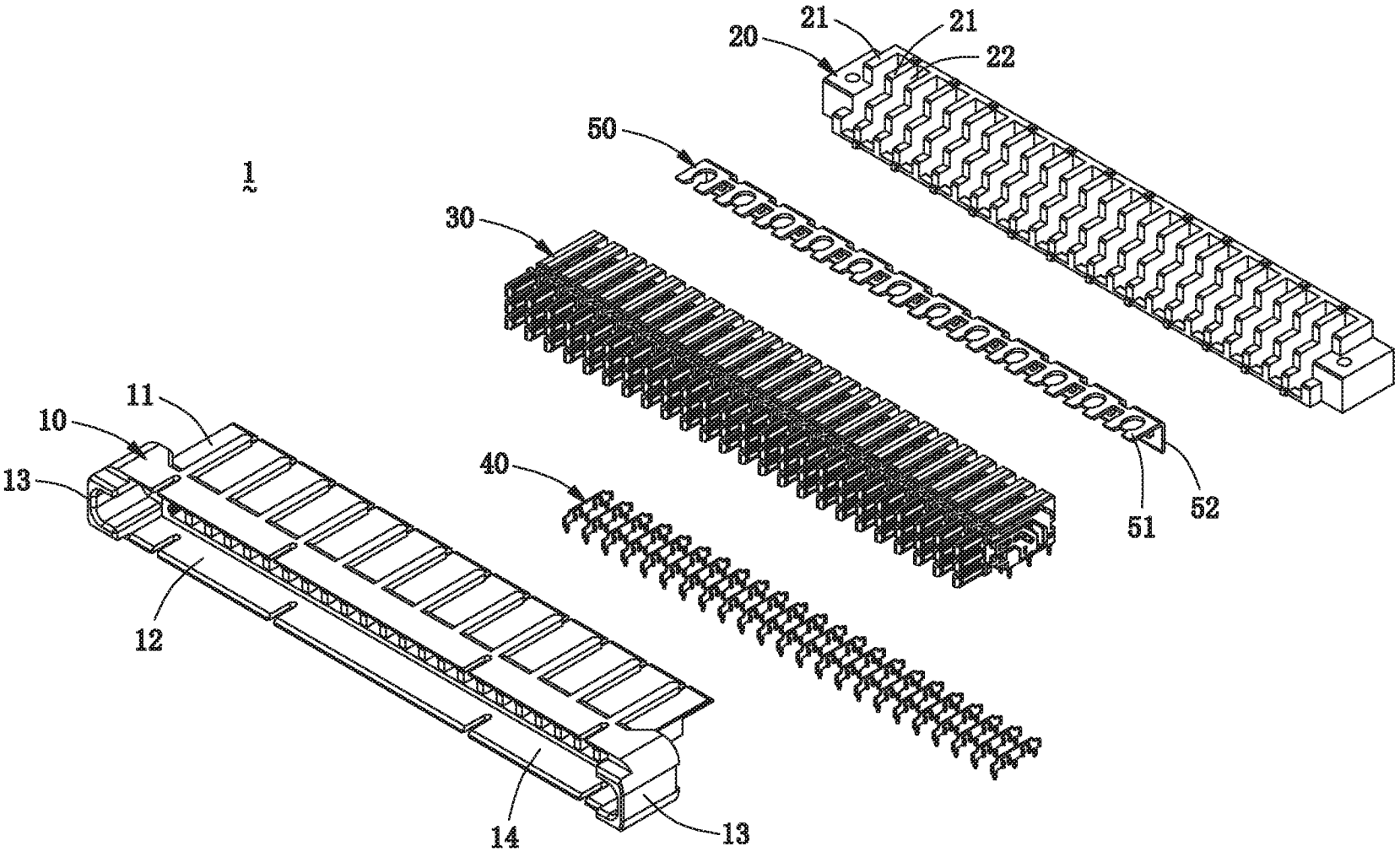
FIG. 2 is an exploded view of the double-shielded high-speed docking connector of the present invention shown in FIG. 1.
Figure 3:
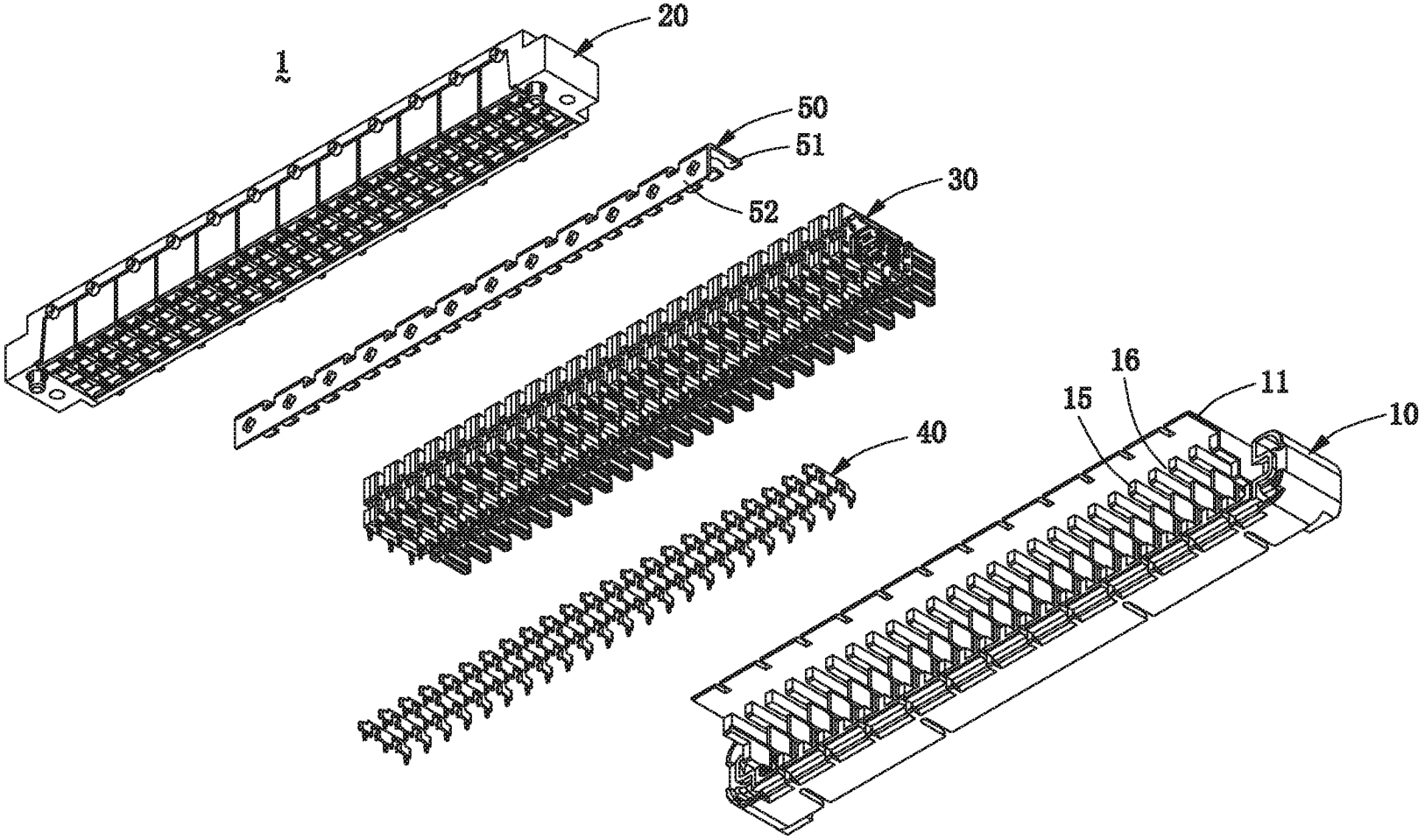
FIG. 3 is an exploded view of the double-shielded high-speed docking connector of the present invention along another direction.
Figure 4:
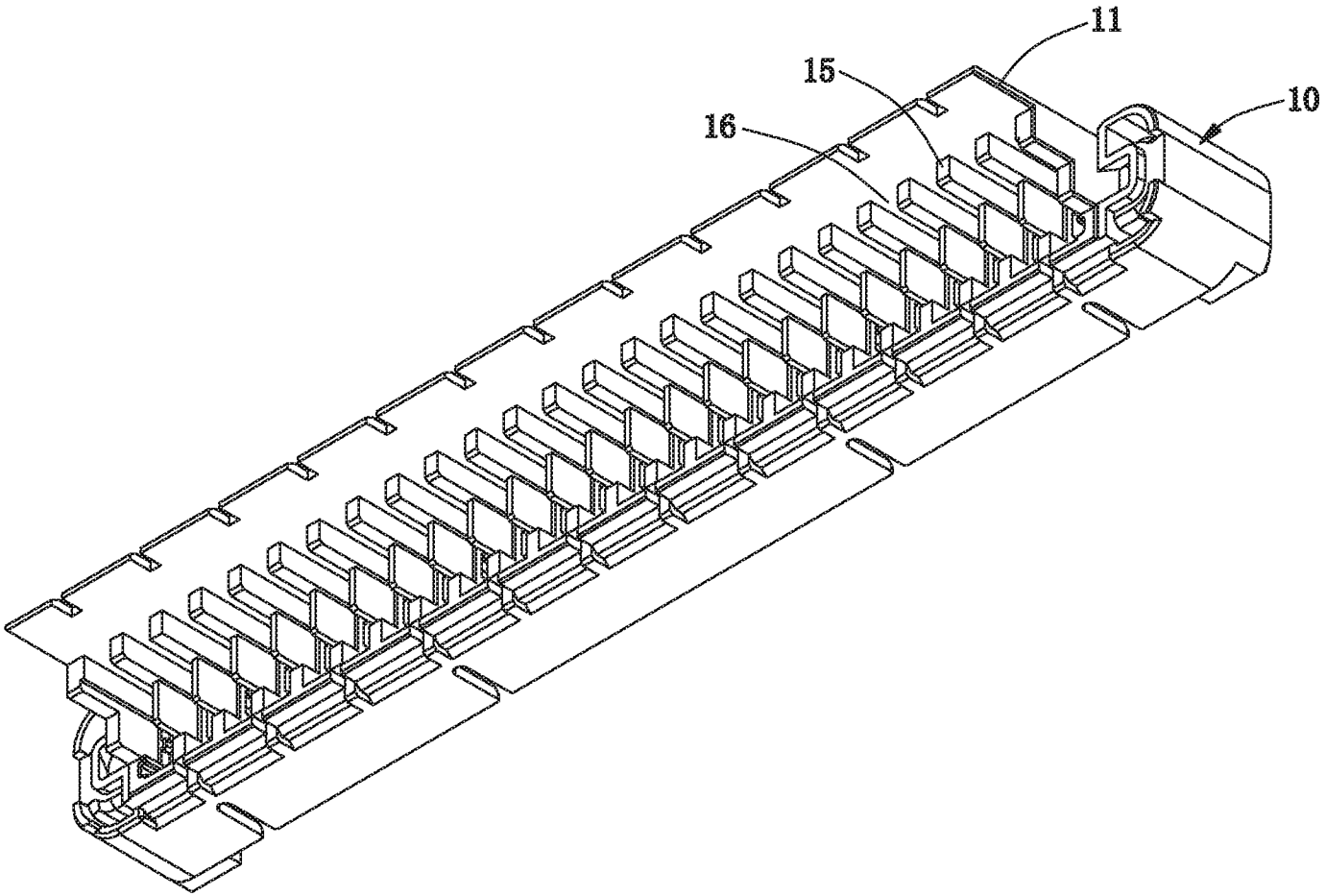
FIG. 4 is a perspective schematic view of a shell of the double-shielded high-speed docking connector of the present invention.
Figure 5:
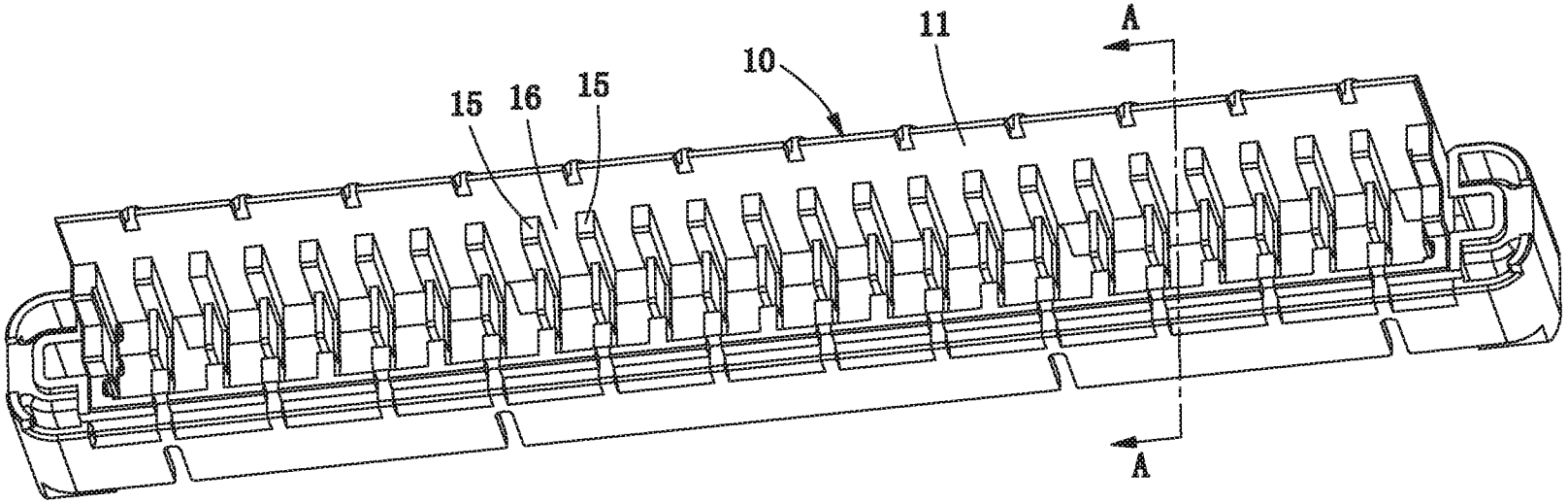
FIG. 5 is a structural view of the shell along another direction.
Figure 6:
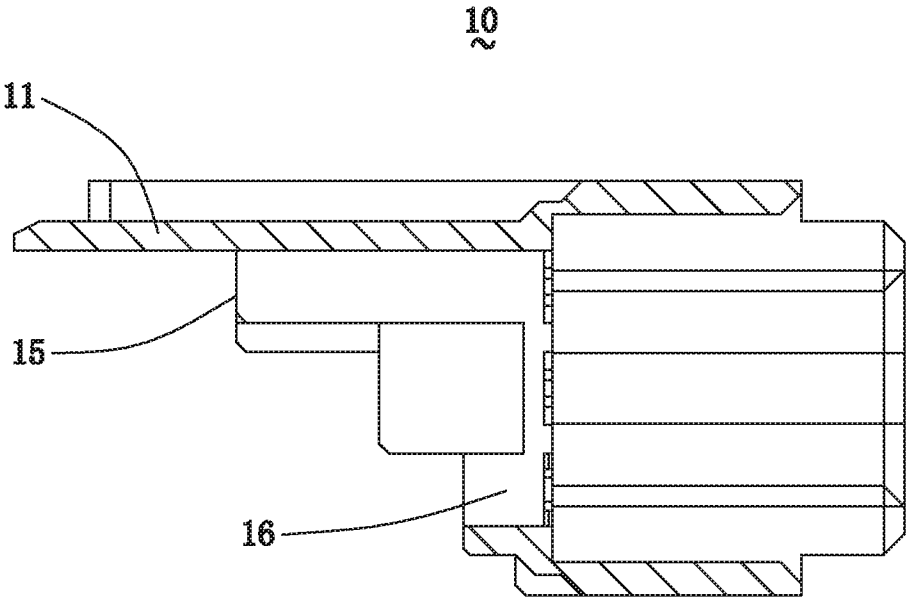
FIG. 6 is a sectional view of the shell along an A-A line in FIG. 5.

Please refer to FIGS. 1, 2 and 3, a double-shielded high-speed docking connector 1 of the present invention here is called a high-speed socket connector, which can be mounted parallel to a circuit board (not shown in all FIGS.). The high-speed docking connector 1 includes a longitudinal shell 10, a longitudinal positioning seat 20 and a row of frame assemblies 30.

Referring to FIG. 2, the shell 10 has a long top wall 11, a short bottom wall 12, two side walls 13, and a cavity 14 defined by the top wall 11, the bottom wall 12 and the two side walls 13. In the embodiment, the shell is a die-casting metal shell, which can provide the function of electromagnetic shielding.

Referring to FIGS. 3, 4, 5 and 6, the shell 10 further has a row of parallel stepped vertical walls 15, and a plurality of horizontal passages 16 separated by the vertical walls 15 and communicated with the cavity 14. All the vertical walls 15 are located on a rear of the shell 10 and perpendicular to the top wall 11.

Figure 7:
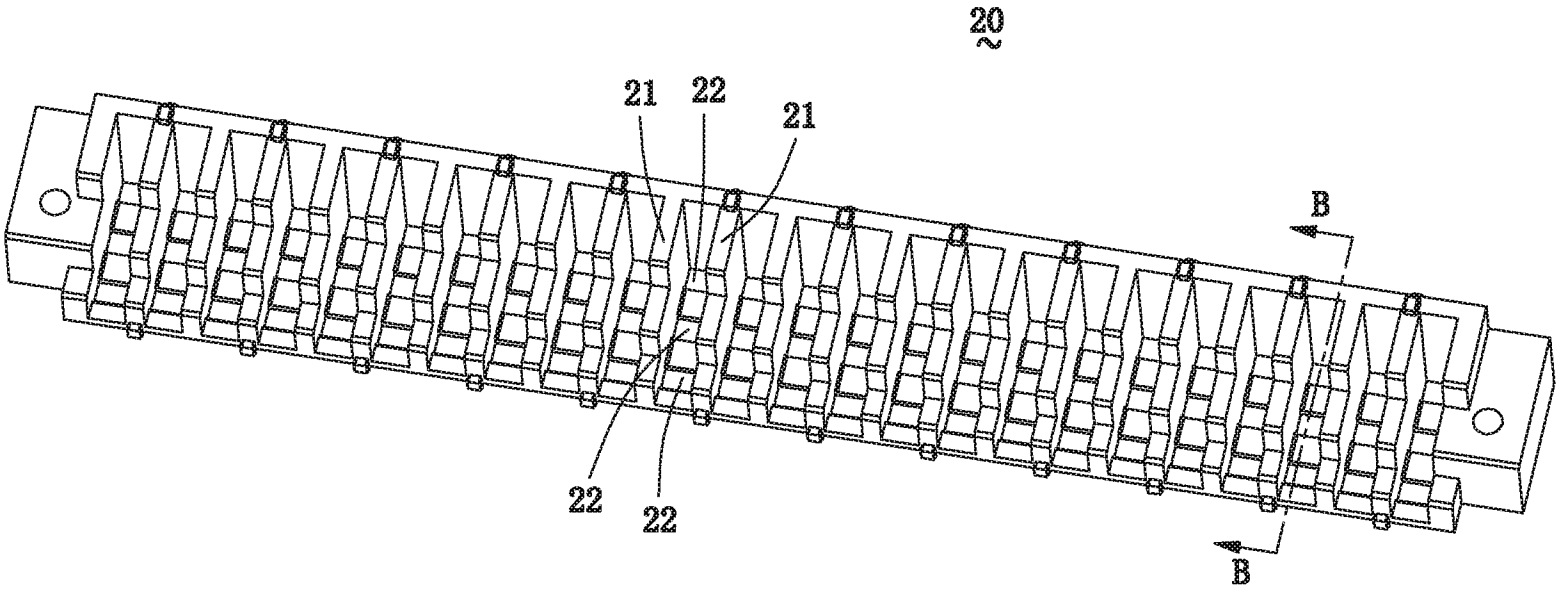
FIG. 7 is a perspective schematic view of a positioning seat of the double-shielded high-speed docking connector of the present invention.
Figure 8:
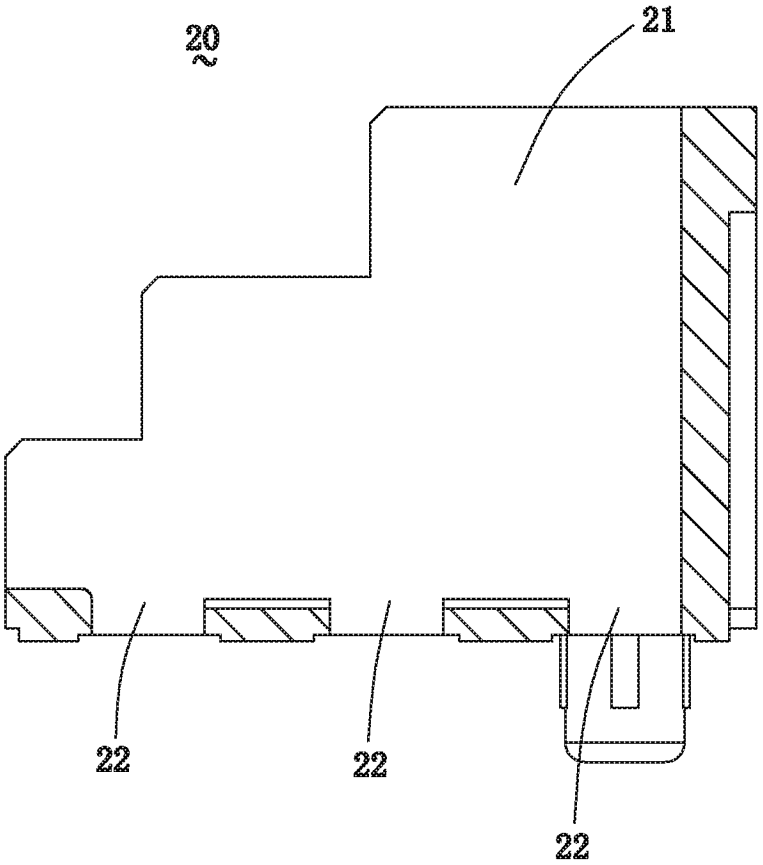
FIG. 8 is a sectional view of the positioning seat along a B-B line of FIG. 7.

Referring to FIGS. 2, 7 and 8, the positioning seat 20 is longitudinal. The positioning seat 20 has a row of parallel stepped upright walls 21, and a plurality of vertical passages 22 (seen in FIG. 8) being separated by the upright walls 21 and passing through a bottom of the positioning seat 20. In the embodiment, there are three vertical passages 22 between each two upright walls 21.

Figure 9:
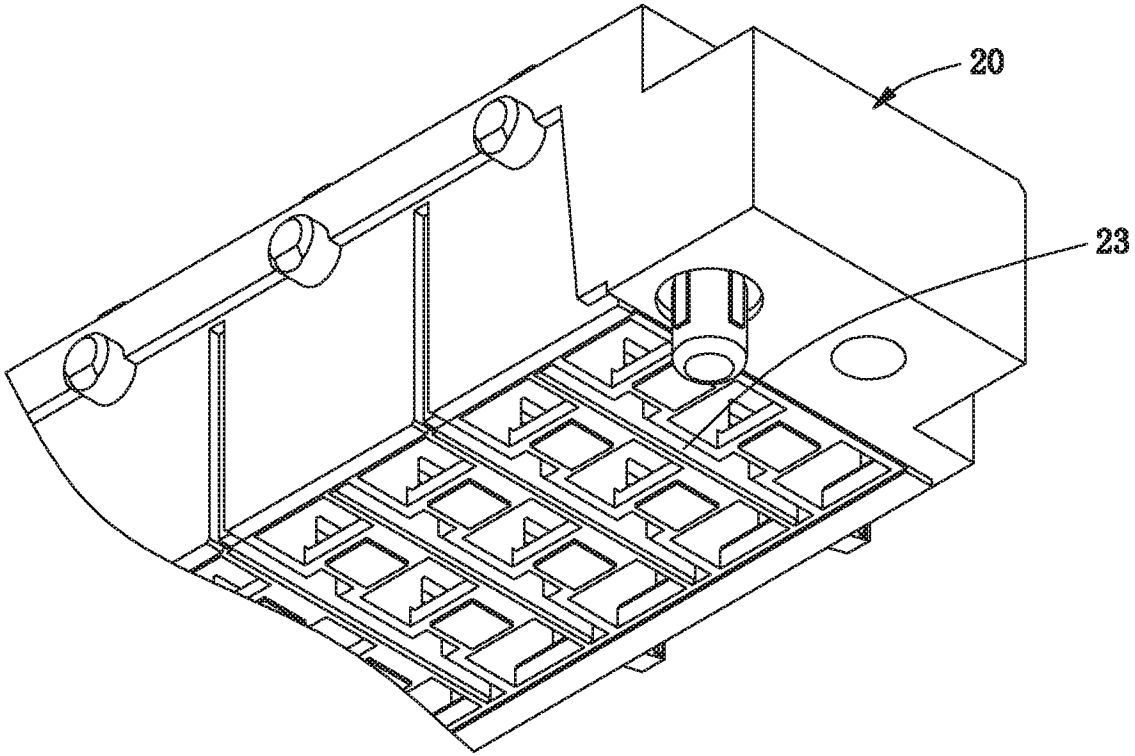
FIG. 9 is an enlarged view of one part on a bottom of the positioning seat of the present invention.

Please refer to FIG. 9, the positioning seat 20 forms a plurality of transverse grounding grooves 23 located on the bottom of the positioning seat 20, and each transverse grounding groove 23 is corresponding to a bottom of one upright wall 21.

Please refer to FIGS. 10, 11, 13 and 14, the frame assembly 30 includes an insulating body 31, two columns of signal terminals 32 supported by the insulating body 31 and arranged to be multiple differential pairs, a first shielding member 33 mounted on one side of the insulating body 31, and a second shielding member 34 mounted on the other side of the insulating body 31 and connected with the first shielding member 33. It should be noted that, the first shielding member 33 and the second shielding member 34 form a grounding connection therebetween. But ways of the "connection" includes, but is not limited to, a direct contact between the first and second shielding members, and a fixed connection formed by fixing the two shielding members together. One of these connections, such as the fixed connections, will be described in detail later.

Figure 11:
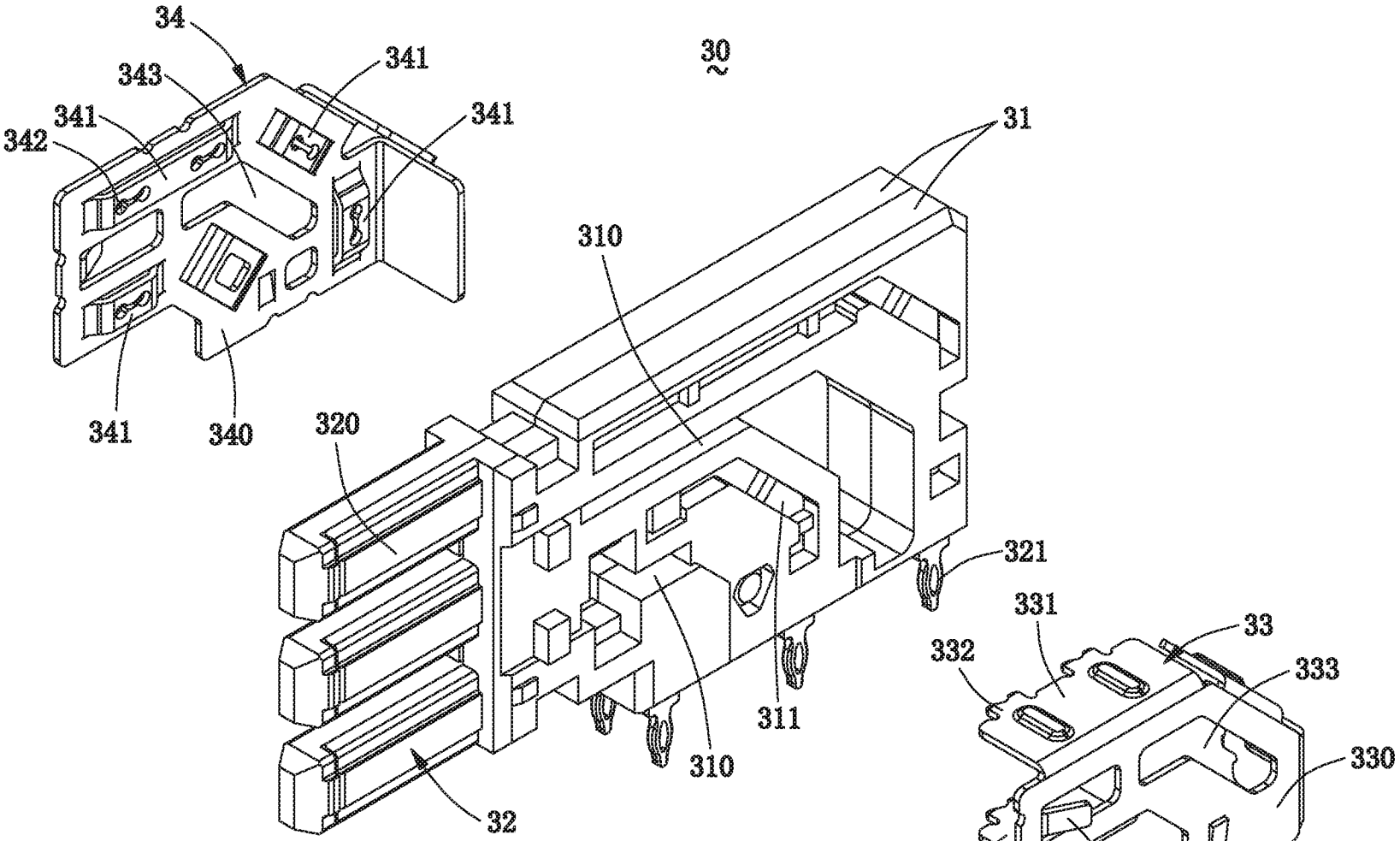
FIG. 11 is an exploded view of the frame assembly shown in FIG. 10, wherein two shielding members are detached from both sides of the frame assembly.

Referring to FIG. 11, the insulating body 31 has at least one retaining groove 310 passing through two sides of the insulating body 31. The retaining groove 310 is located between the signal terminals 32 of two adjacent differential pairs. Moreover, the insulating body 31 further disposes at least one heat dissipation channel 311 on each side thereof.

Figure 12:
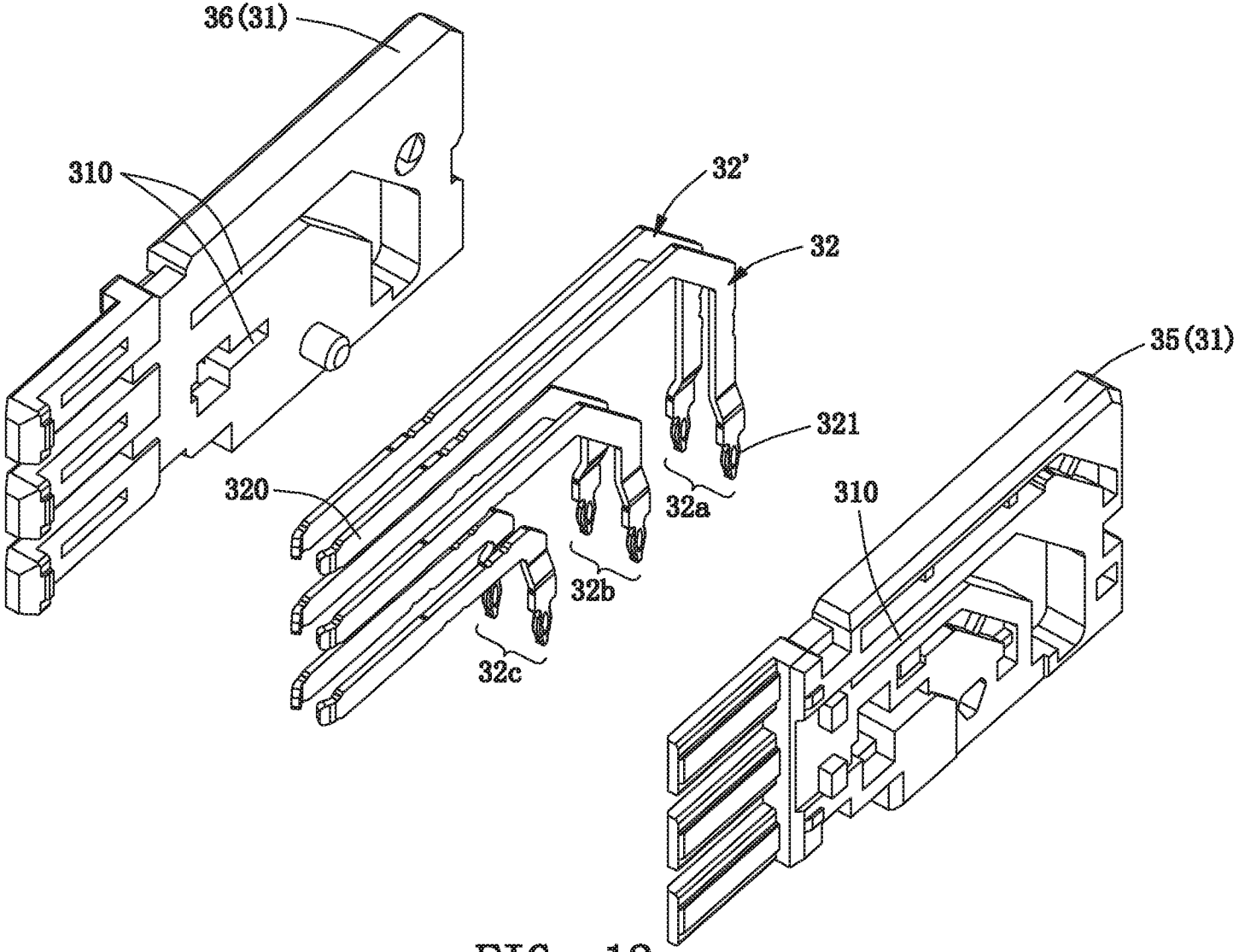
FIG. 12 is a structural view of the frame assembly further disassembled as shown in FIG. 11.
Figure 13:
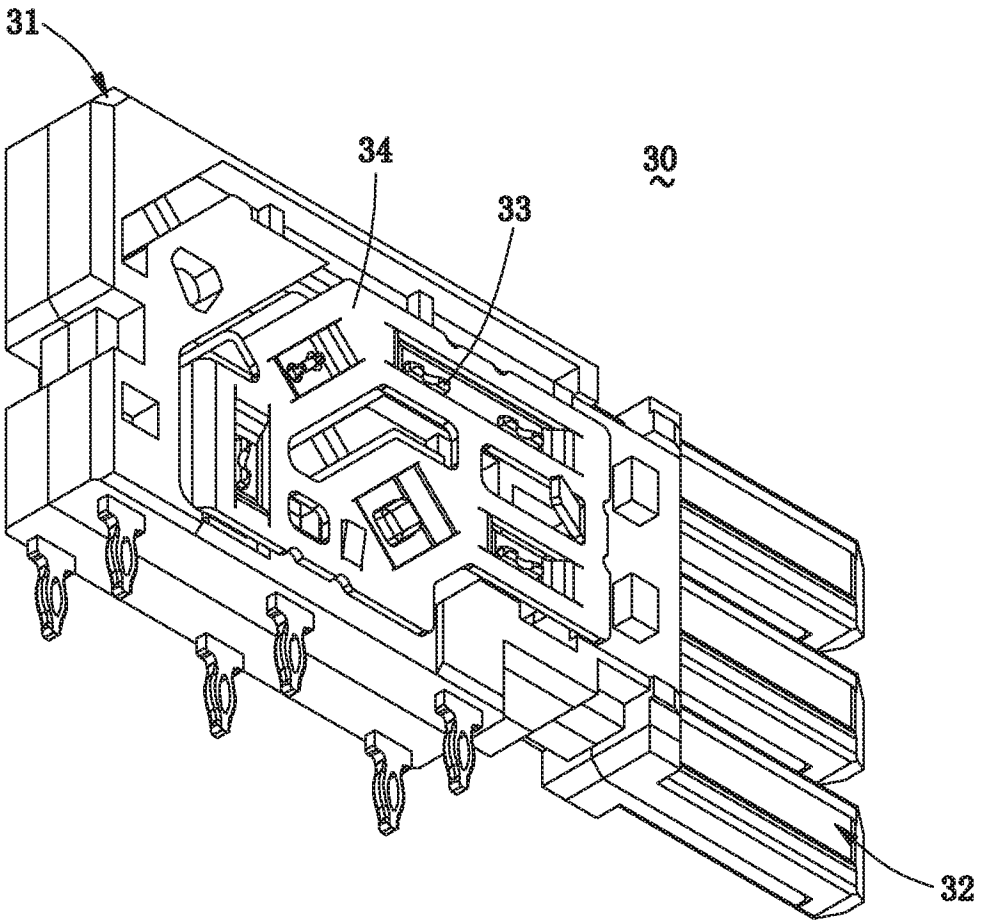
FIG. 13 is a structural view of the frame assembly of the present invention along another direction.

In the embodiment, referring to FIG. 12, the insulating body 31 is combined by two half parts 35, 36. One half part 35 supports one column of signal terminals 32, and the other half part 36 supports the other column of signal terminals 32'. When the two half parts 35, 36 are combined together, the two columns of signal terminals 32, 32' construct multiple differential pairs 32*a*, 32*b*, 32*c*. The retaining groove 310 passes through the two half parts 35, 36.

Now, the structure of the insulating body 31 is described by taking one half part 35 as an example. Please refer to FIG. 12, the half part 35 has multiple retaining grooves 310, and there is at least one retaining groove 310 between each two adjacent signal terminals 32 on the half part 35. The retaining grooves 310 have different shapes. For example, an upper retaining groove 310 is L-shaped, and a lower retaining groove 310 is straight line. When the two half parts 35, 36 are combined together, the retaining grooves 310 on one half part 35 are communicated with the corresponding retaining grooves 310 on the other half part 36.

Referring to FIGS. 11 and 12, each signal terminal 32 has a conductive contact portion 320 exposed on a front of the insulating body 31, and a conductive tail 321 extending out of a bottom of the insulating body 31. In the embodiment, the frame assembly 30 has six signal terminals 32, which are arranged to be three differential pairs 32*a*, 32*b*, 32*c*.

Figure 14:
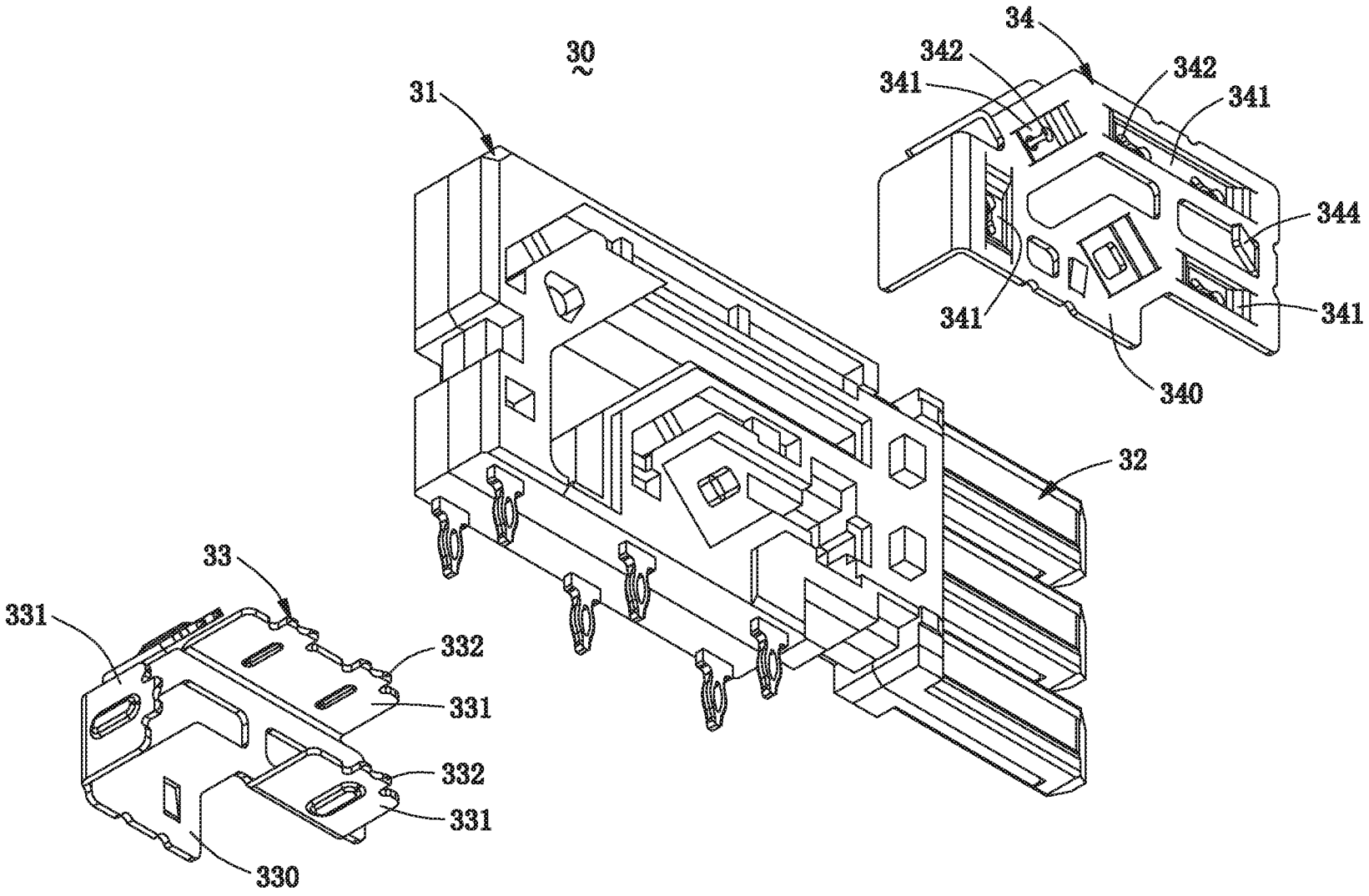
FIG. 14 is an exploded view of the frame assembly shown in FIG. 13, wherein two shielding members are detached from both sides of the frame assembly.

Referring to FIGS. 11 and 14, the first shielding member 33 has a first vertical main portion 330, and at least one retaining arm 331 being perpendicular to the first vertical main portion 330. The first vertical main portion 330 can be attached onto one side of the insulating body 31, and the retaining arm 331 can enter into the corresponding retaining groove 310 of the insulating body 31 to be ready for being engaged with the second shielding member 34. Moreover, the retaining arm 331 is vertically bent toward the insulating body 31, and forms at least one dentate insertion plate 332 on a front end of the retaining arm. In the embodiment, the first shielding member 33 has three retaining arms 331 being perpendicular to the first vertical main portion 330, and some of the retaining arms 331 form two dentate insertion plates 332. Of course, in other embodiments, the number of the retaining arms 331 and the dentate insertion plates 332 can be changed according to the structural requirements.

Figure 15:
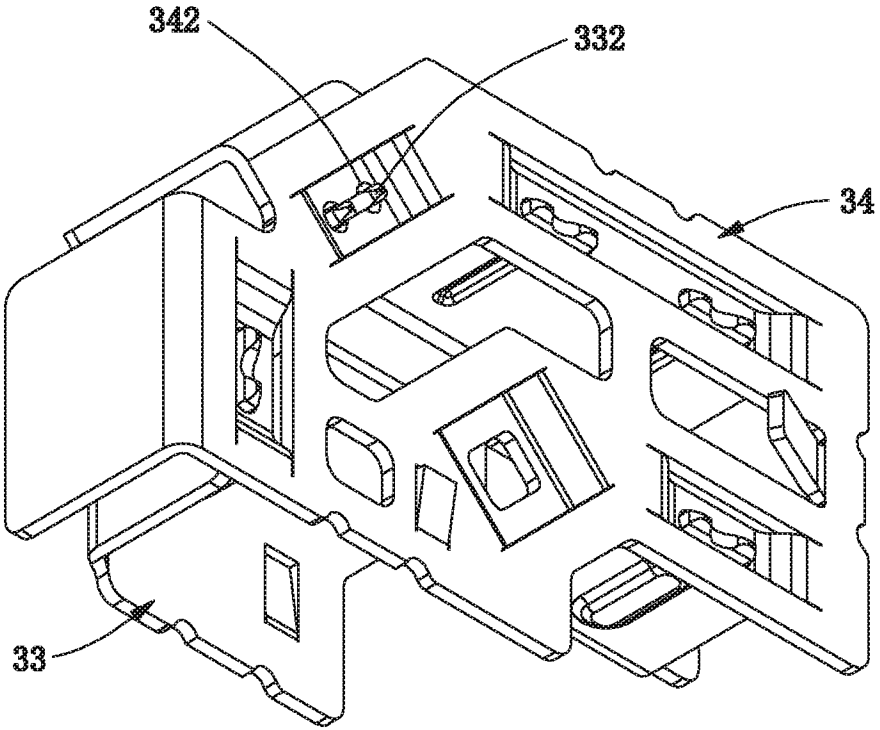
FIG. 15 shows a configuration relationship between two shielding elements of the present invention.

Referring to FIGS. 11 and 14, the second shielding member 34 has a second vertical main portion 340, at least one elastic panel 341 formed on the second vertical main portion 340, and at least one locking hole 342 formed on the elastic panel 341. The second vertical main portion 340 can be attached onto the other side of the insulating body 31, and the locking hole 342 is aligned with the corresponding retaining groove 310 to be ready for receiving the front end of the corresponding retaining arm 331 of the first shielding member 33. Specifically, please refer to FIGS. 11 and 15, the dentate insertion plate 332 of the first shielding member 33 can be inserted into the locking hole 342 of the second shielding member 34, so the first and second shielding members 33, 34 are connected together and form a whole. At the same time, the first and second shielding members 33, 34 are firmly fixed on the insulating body 31. Moreover, the elastic panel 341 is protruding toward the insulating body 31 for ensuring that the dentate insertion plate 332 and the locking hole 342 will not loosen after locking together. In the embodiment, the second shielding member 34 has multiple elastic panels 341 and multiple locking holes 342. It can be seen that the number of the locking holes 342 can be determined according to the actual structure.

In more detail, the first shielding member 33 is mounted on one side of one half part 35, and the first main portion 330 is far away from the other half part 36. The second shielding member 34 is mounted on one side of the other half part 36, and the second main portion 340 is far away from the one half part 35.

Furthermore, referring to FIG. 11, the first shielding member 33 further has at least one first opening 333 formed on the first vertical main portion 330, and the second shielding member 34 further has at least one second opening 343 formed on the second vertical main portion 340. The first and second openings 333, 343 are corresponding to and communicated with the heat dissipation channel 311 for keeping the heat dissipation channel 311 unobstructed.

Referring to FIG. 11, the first shielding member 33 further has at least one first bending sheet 334, which is formed by being bent far away from the insulating body 31. The bending sheet 334 can contact with the second shielding member of one adjacent frame assembly to form a complete shield. Similarly, referring to FIG. 14, the second shielding member 34 further has at least one second bending sheet 344, which is formed by being bent far away from the insulating body 31. The second bending sheet 344 can contact with the first shielding member of the other adjacent frame assembly to form a complete shield.

Of course, the first shielding member 33 or/and the second shielding member 34 further dispose some structures, which can be engaged with the insulating body 31, to enhance a bonding force between the two shielding member 33, 34 and the insulating body 31.

When assembling, referring to FIG. 11, the first shielding member 33 is mounted on one side of the insulating body 31, and each retaining arm 331 can enter into the corresponding retaining groove 310 of the insulating body 31, thereby separating the signal terminals 32 of two adjacent differential pairs located on two sides of the retaining groove 310 and reducing the crosstalk between the signal terminals 32 of the two adjacent differential pairs. The second shielding member 34 is mounted on the other side of the insulating body 31, and the dentate insertion plate 332 of the first shielding member 33 can be inserted into the locking hole 342 of the second shielding member 34, so the first and second shielding members 33, 34 are fixed onto the insulating body 310.

Figure 10:
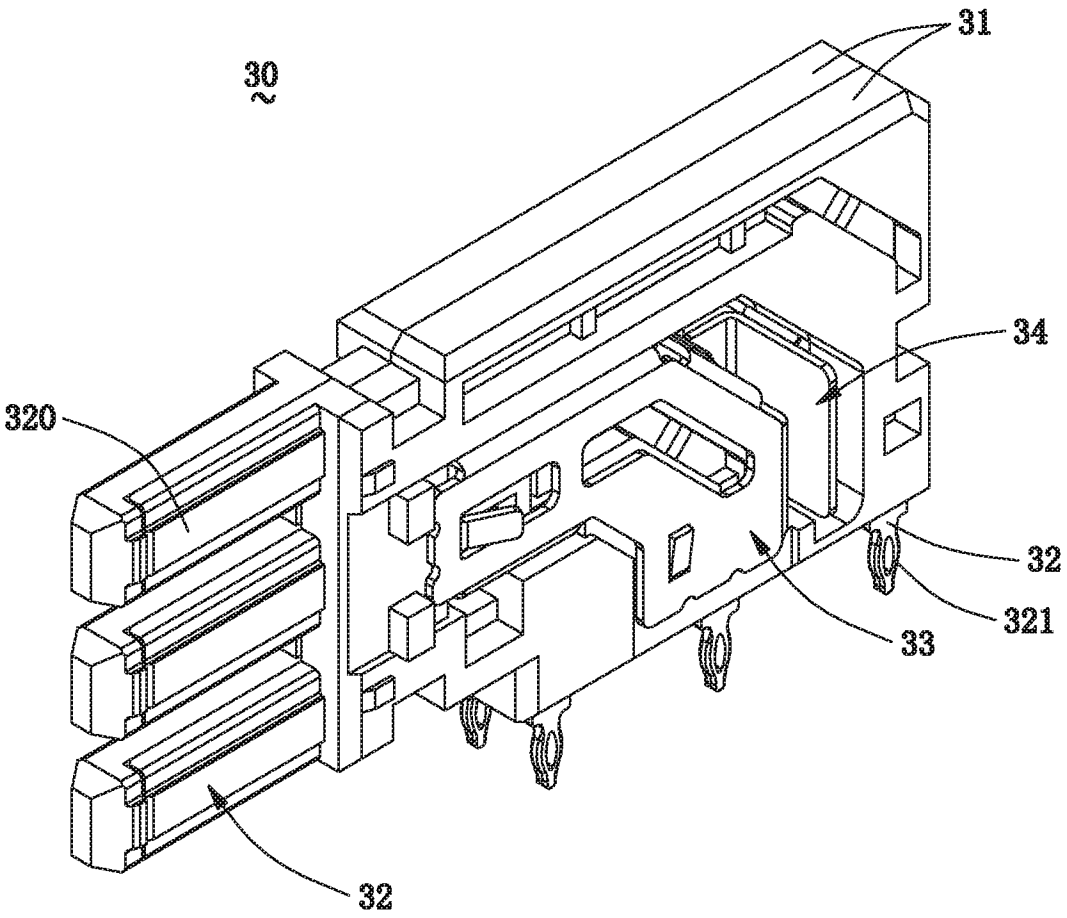
FIG. 10 is a structural view of one frame assembly shown in FIG. 2 and having multiple signal terminals, which are arranged to be differential pairs.
Figure 17:
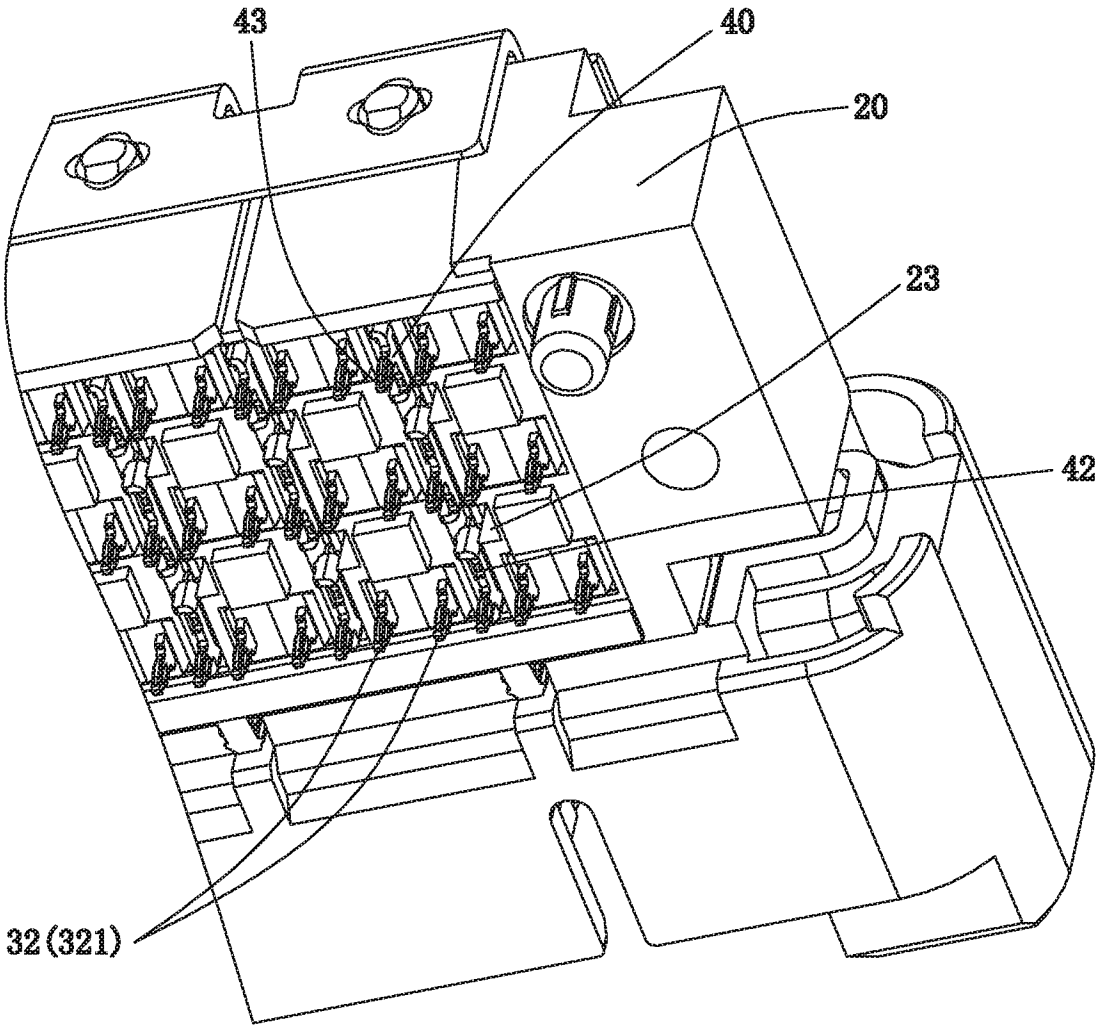
FIG. 17 shows a bottom of the double-shielded high-speed docking connector of the present invention, and mainly shows a partial structure of the bottom thereof.

When assembling, please refer to FIGS. 2, 3 and 10, the conductive contact portions 320 of each frame assembly 30 can pass through the corresponding horizontal passages 16 from the rear of the shell 10 to enter into the cavity 14 (seen in FIG. 14) of the shell 10, for being ready to be mated with a high-speed plug connector. The conductive tail 321 of the frame assembly 30 can pass through the corresponding vertical passage 22 from a top of the positioning seat 20 and extend out of the bottom of the positioning seat 20, as shown in FIG. 17. Now, the stepped upright walls 21 of the positioning seat 20 are matched with the stepped vertical walls 15 of the shell 10, thereby surrounding the frame assemblies 30 to form a whole.

Referring to FIGS. 2 and 3, the double-shielded high-speed docking connector 1 further includes a row of mountain-like grounding pieces 40.

Figure 16:
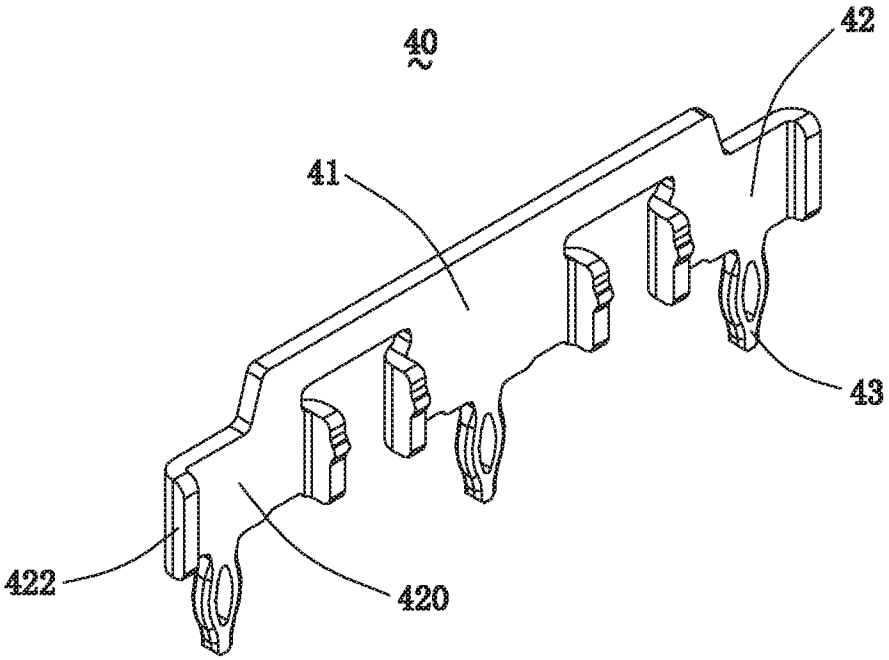
FIG. 16 is a structural view of a grounding piece of the present invention.

Referring to FIG. 16, each grounding piece 40 is in the shape of mountains. The grounding piece 40 has a transverse beam 41, three U-shaped holding portions 42 formed on the transverse beam 41, and at least one grounding tail 43 formed on one of the holding portions. In the embodiment, the transverse beam 41 is vertical holding plate-like. Each U-shaped holding portion 42 has a base portion 420 and two arm portions 422 being symmetrically located on two sides of the base portion 420 and being perpendicular to the base portion 420. In the embodiment, the grounding tail 43 is needle-eye shaped and extends downward from a bottom of the base portion 420. In one embodiment, the grounding piece 40 has three grounding tails 43, which are formed on the three U-shaped holding portions 42, respectively.

When assembling, please refer to FIGS. 9 and 17, each grounding piece 40 is mounted in the corresponding transverse grounding groove 23 of the positioning seat 20. Each U-shaped holding portion 42 is aligned with the signal terminals 32 of the differential pairs. The three grounding tails 43 extend out of the bottom of the positioning seat 20.

Furthermore, referring to FIGS. 2 and 3, the double-shielded high-speed docking connector 1 of the present invention further includes a long strip-like fixer 50. The fixer 50 has a horizontal holding plate 51 and a vertical holding plate 52, which are perpendicular to each other. The horizontal holding plate 51 is fixed on the top wall 11 of the shell, and the vertical holding plate 52 is fixed on a rear of the positioning seat 20.

Figure 18:
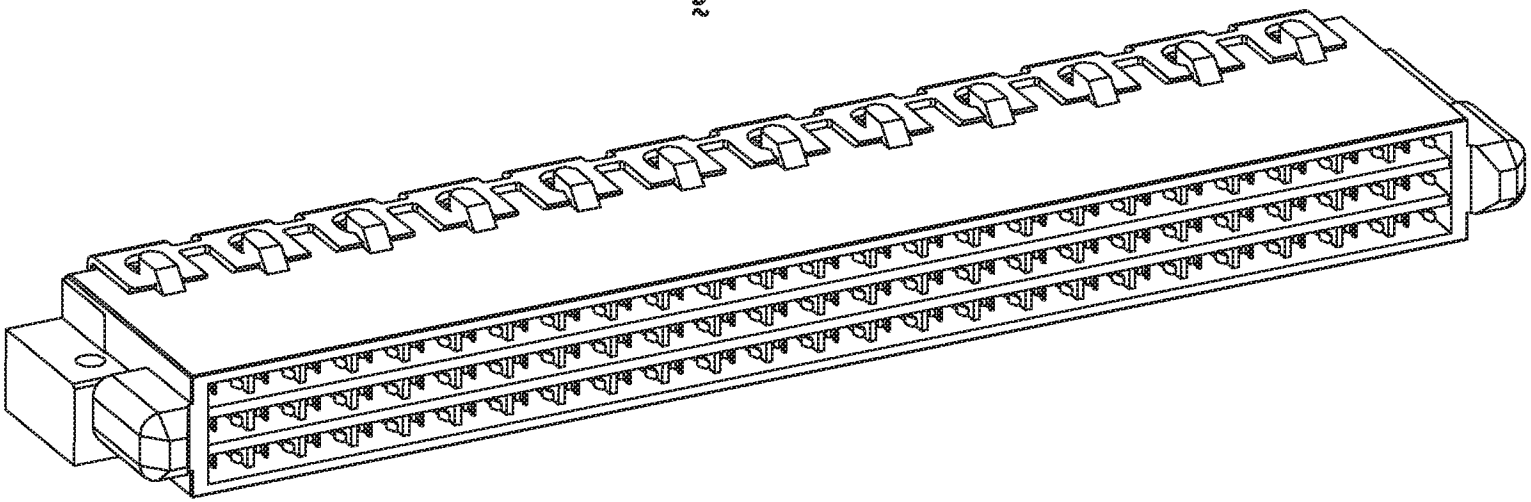
FIG. 18 is a perspective schematic view of a high-speed plug connector, which can be engaged with the double-shielded high-speed docking connector of the present invention.
Figure 19:
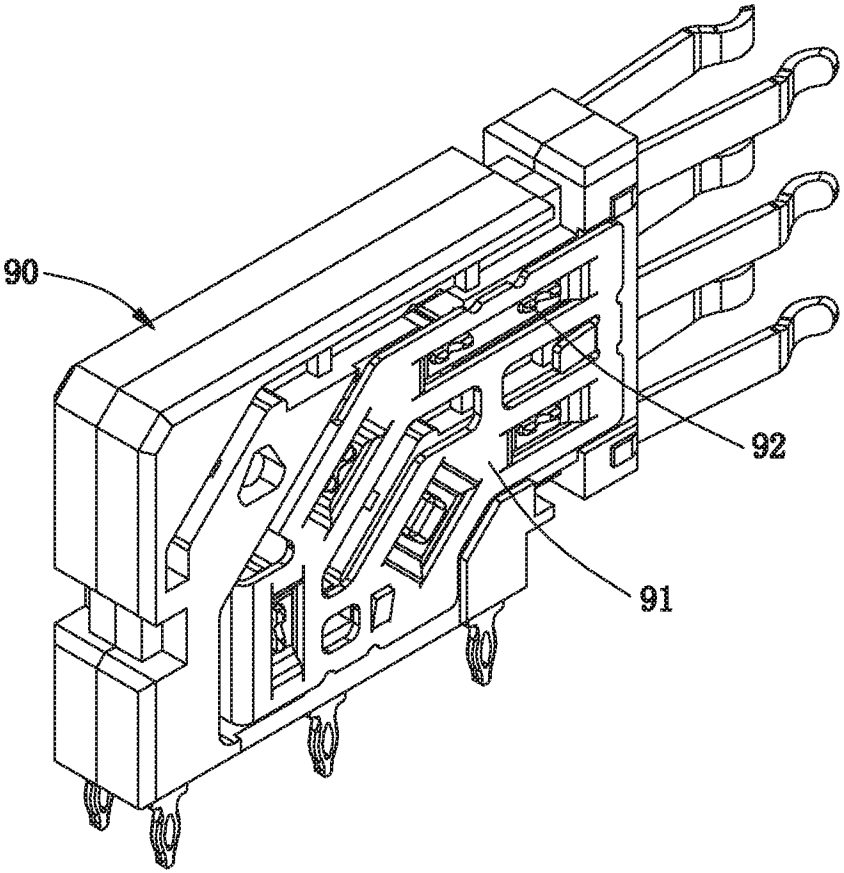
FIG. 19 is a structural view of one frame assembly of the high-speed plug connector of FIG. 18.

Please refer to FIG. 18, the present invention further provides another double-shielded high-speed docking connector, which is called a high-speed plug connector 9 here. Referring to FIG. 19, a plug frame assembly 90 of the high-speed plug connector 9 also disposes two shielding members 91, 92 for effectively reducing crosstalk between signal plug terminals of adjacent differential pairs.

Figure 20:
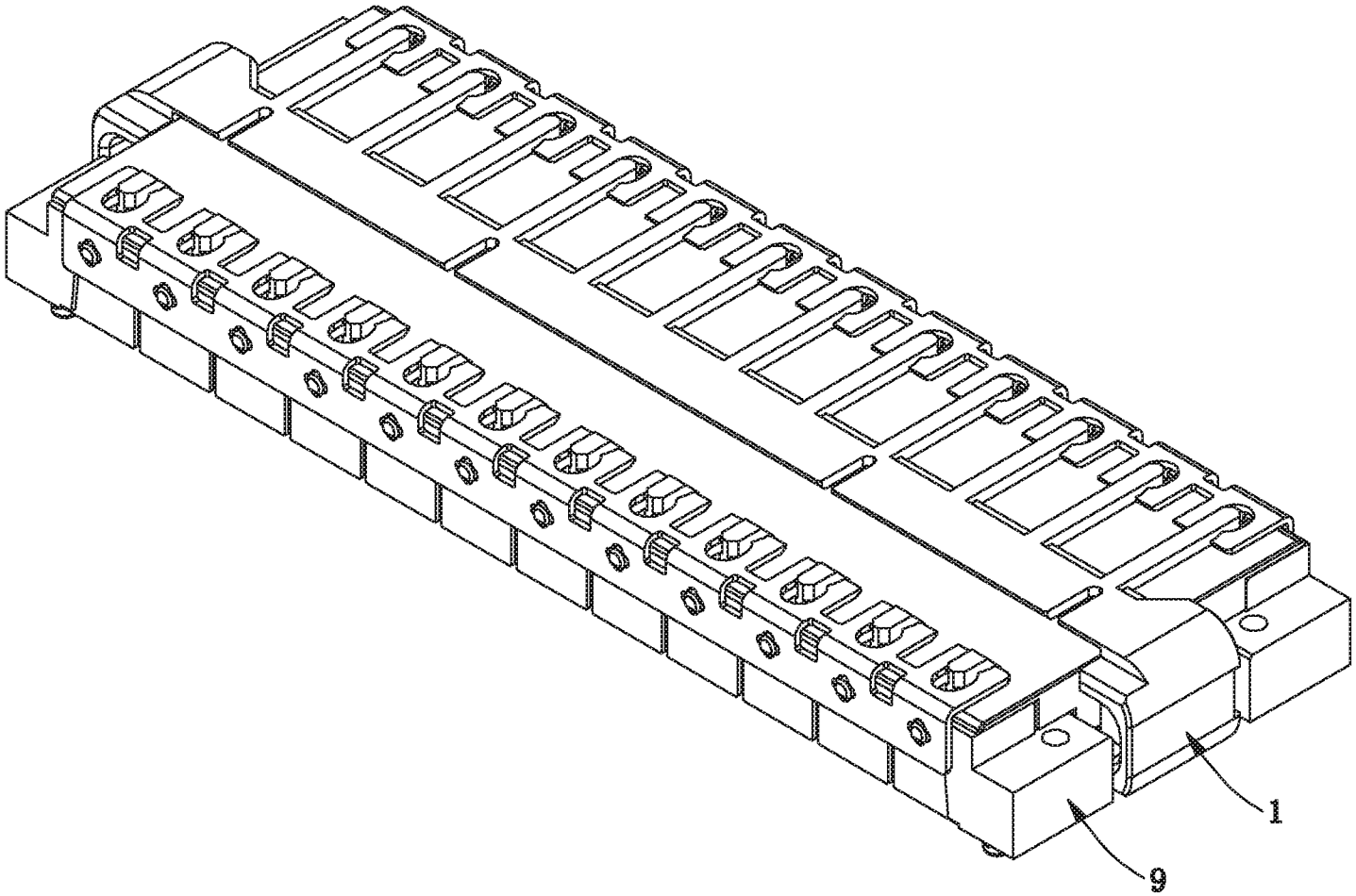
FIG. 20 is a schematic view after the double-shielded high-speed docking connector shown in FIG. 1 is mated with the high-speed plug connector shown in FIG. 18.

Referring to FIG. 20, the high-speed plug connector 9 can be mated with a high-speed receptacle connector (that is, the double-shielded high-speed docking connector 1).

As described above, the double-shielded high-speed docking connector 1 of the present invention disposes double shielding structures connected or combined together, such as the first shielding member 33 and the second shielding member 34, in each frame assembly 30, thereby not only reducing the crosstalk between the signal terminals 32 of adjacent differential pairs, but also effectively reducing signal interference of adjacent frame assemblies 30. Moreover, the present invention disposes the grounding pieces 40 to further reduce the crosstalk.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A double shielded high-speed docking connector, characterized in that: comprising a longitudinal die-casting metal shell, a longitudinal positioning seat and a row of frame assemblies;

the shell having a top wall, a bottom wall, two side walls, and a cavity defined by the top wall, the bottom wall and the two side walls; the shell further having a row of parallel stepped vertical walls located on a rear of the shell and perpendicular to the top wall, and a plurality of horizontal passages separated by the vertical walls and communicated with the cavity;

the positioning seat having a row of parallel stepped upright walls, and a plurality of vertical passages separated by the upright walls and passing through a bottom of the positioning seat; and each frame assembly including an insulating body, two columns of signal terminals supported by the insulating body and arranged to be multiple differential pairs, a first shielding member mounted on one side of the insulating body, and a second shielding member mounted on the other side of the insulating body and connected with the first shielding member;

wherein each signal terminal has a conductive contact portion exposed on a front of the insulating body, and a conductive tail extending out of a bottom of the insulating body; the conductive contact portion passing through the corresponding horizontal passage to enter into the cavity of the shell; and the conductive tail passing through the corresponding vertical passage to extend out of the bottom of the positioning seat;

wherein the insulating body has at least one retaining groove passing through two sides of the insulating body and located between the signal terminals of two adjacent differential pairs;

the first shielding member has a first vertical main portion attached on one side of the insulating body, and at least one retaining arm entering into the retaining groove of the insulating body; and the second shielding member has a second vertical main portion attached on the other side of the insulating body, and at least one elastic panel formed on the second vertical main portion, and at least one locking hole formed on the elastic panel and aligned with the retaining groove; wherein a front end of the retaining arm of the first shielding member inserts into the locking hole of the second shielding member to make the first and second shielding member be connected and fixed on the insulating body together.

2. The double shielded high-speed docking connector as claimed in claim 1, characterized in that: the insulating body is combined by two half parts, one of which supports one column of signal terminals, and the other of which supports the other column of signal terminals; the two half parts are combined together to make the two columns of signal terminals construct multiple differential pairs; the retaining groove passes through the two half parts, and there is at least one retaining groove between each two adjacent signal terminals on each half part.

3. The double shielded high-speed docking connector as claimed in claim 1, characterized in that: the retaining arm of the first shielding member is vertically bent toward the insulating body, and forms at least one dentate insertion plate on the front end of the retaining arm; and the elastic panel of the second shielding member protrudes toward the insulating body.

4. The double shielded high-speed docking connector as claimed in claim 1, characterized in that: the insulating body further disposes at least one heat dissipation channel on each side thereof;

the first shielding member further has at least one first opening formed on the first vertical main portion; and the second shielding member further has at least one second opening formed on the second vertical main portion;

wherein the first and second openings are corresponding to and communicated with the heat dissipation channel of the insulating body.

5. The double shielded high-speed docking connector as claimed in claim 1, characterized in that: the first shielding member further has at least one first bending sheet, which is formed by being bent far away from the insulating body for contacting with the second shielding member of one adjacent frame assembly; and the second shielding member further has at least one second bending sheet, which is formed by being bent far away from the insulating body for contacting with the first shielding member of the other adjacent frame assembly.

6. The double shielded high-speed docking connector as claimed in claim 1, characterized in that: the double shielded high-speed docking connector further includes a row of mountain-like grounding pieces; and the positioning seat forms a plurality of transverse grounding grooves located on the bottom of the positioning seat, and each transverse grounding groove is corresponding to a bottom of one corresponding upright wall; wherein each grounding piece is mounted in the corresponding transverse grounding groove.

7. The double shielded high-speed docking connector as claimed in claim 6, characterized in that: each grounding piece is in the shape of mountains; and the grounding piece has a transverse beam, three U-shaped holding portions formed on the transverse beam, and three grounding tails formed on the U-shaped holding portions respectively.

8. The double shielded high-speed docking connector as claimed in claim 7, characterized in that: each U-shaped holding portion has a base portion and two arm portions being symmetrically located on two sides of the base portion and being perpendicular to the base portion.

9. The double shielded high-speed docking connector as claimed in claim 1, characterized in that: the double shielded high-speed docking connector further includes a long strip-like fixer, which has a horizontal holding plate and a vertical holding plate being perpendicular to each other; the horizontal holding plate is fixed on the top wall of the shell, and the vertical holding plate is fixed on a rear of the positioning seat.

* * * * *